US006915926B2

(12) United States Patent
Naik

(10) Patent No.: US 6,915,926 B2
(45) Date of Patent: Jul. 12, 2005

(54) BEVERAGE DISPENSER

(75) Inventor: Ashok Kumar Naik, Kamataka (IN)

(73) Assignee: Unilever Bestfoods, North America, a division of Conopco, Inc., Englewood Cliffs, NJ (US)

( * ) Notice: Subject to any disclaimer, the term of this patent is extended or adjusted under 35 U.S.C. 154(b) by 124 days.

(21) Appl. No.: 10/459,240

(22) Filed: Jun. 11, 2003

(65) Prior Publication Data

US 2003/0230597 A1 Dec. 18, 2003

(30) Foreign Application Priority Data

Jun. 13, 2002 (IN) ..... 520/MUM/02
Jul. 8, 2002 (GB) ..... 0215818

(51) Int. Cl.[7] ..... B67D 5/56

(52) U.S. Cl. ..... 222/146.6; 222/54; 222/129.1; 222/192.2; 222/144.5; 222/148; 222/146.1

(58) Field of Search ..... 222/129–129.4, 222/144.5, 146.1, 54, 146.6, 148

(56) References Cited

U.S. PATENT DOCUMENTS

| | | | | |
|---|---|---|---|---|
| 4,116,246 A | | 9/1978 | Franzen | |
| 4,211,342 A | | 7/1980 | Jamgochian et al. | |
| 4,566,287 A | | 1/1986 | Schmidt et al. | |
| 4,792,059 A | * | 12/1988 | Kerner et al. | 222/67 |
| 5,042,689 A | * | 8/1991 | Mrugala et al. | 222/66 |
| 5,353,958 A | | 10/1994 | Hawkins | |
| 5,413,742 A | * | 5/1995 | Gatter | 261/140.1 |
| 5,819,784 A | * | 10/1998 | Yoon | 137/312 |
| 5,975,365 A | * | 11/1999 | Hsieh | 222/129.4 |
| 6,149,035 A | | 11/2000 | Gorski et al. | |
| 6,240,829 B1 | | 6/2001 | McGarrah | |
| 6,460,735 B1 | * | 10/2002 | Greenwald et al. | 222/146.1 |
| 6,685,059 B2 | * | 2/2004 | Jones et al. | 222/129.1 |

FOREIGN PATENT DOCUMENTS

| | | |
|---|---|---|
| FR | 2 244 704 A | 9/1973 |
| FR | 2 692 129 | 12/1993 |
| GB | 2 031 378 | 4/1980 |

OTHER PUBLICATIONS

Great Britain Search Report on GB Application No. GB 0215818.6 dated Mar. 27, 2003.

International Search Report claiming priority on PCT/EP 03/05961 mailed Aug. 26, 2003.

* cited by examiner

*Primary Examiner*—J. Casimer Jacyna

(57) ABSTRACT

A cold beverage dispenser for beverages such as iced tea where the supplied water used for the preparation of the beverage is effectively controlled to a desired temperature depending on the beverage to be prepared. A source of water is split into two separate streams. One of the streams is passed through chiller unit. A distribution means controls the quantity of water and the amount of time the water spends in the chiller unit. Temperature detecting means is provided on both branches to control the proportion of the water in the first and second streams. A beverage mixing unit is provided that is connected to a source of premix powder.

4 Claims, 1 Drawing Sheet

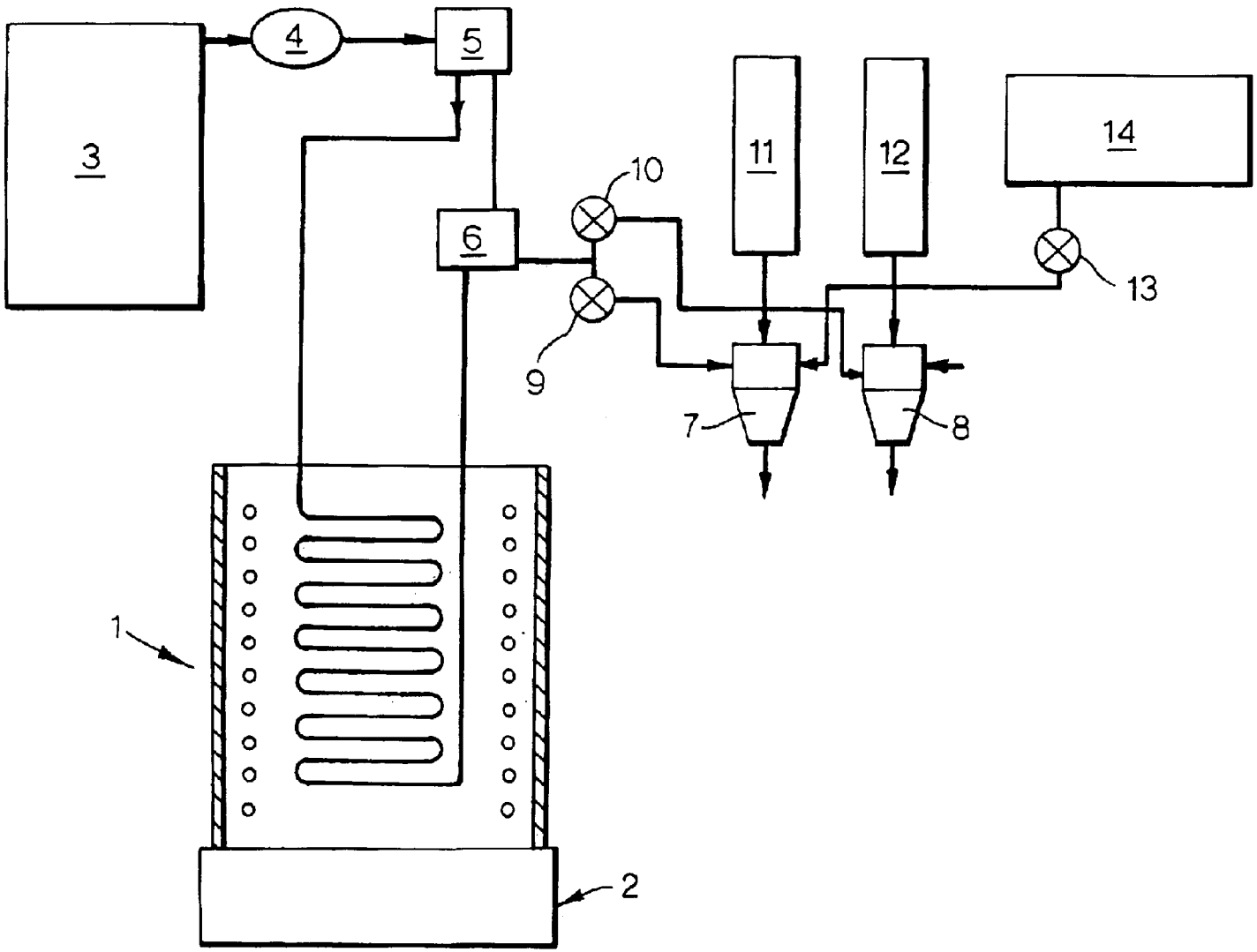
14
13
12
8
11
7
10
9
5
6
4
3
2
1

BEVERAGE DISPENSER

TECHNICAL FIELD

This invention relates to a beverage dispenser for beverages such as ice tea, coffee and the like and in particular to an ice tea beverage dispenser adapted to serve desired quality of instant beverage automatically into serving glasses/containers.

BACKGROUND ART

Beverage dispensers for tea, coffee, chocolates and the like are well known and have been in use.

U.S. Pat. No. 4,116,246 discloses beverage dispensers for dry granular base food products having means for metering the desired quantity of the dry food powder with hot or cold water to form the drink which can be instant tea, coffee or hot chocolate.

U.S. Pat. No. 4,211,342 discloses a vending machine for beverages which provide for a selection of either hot or cold beverages from the same machine to add consumer satisfaction. The system involves an electric control system which is adapted to facilitate the necessary separation of functions between the hot and cold beverage systems of the machine.

It is also known to have machines for dispensing freshly mixed cup of juice or other beverages made from concentrate mixed with water immediately prior to the dispensing. U.S. Pat. No. 4,566,287 discloses a system involving a refrigeration unit to chill the water for the instant beverage to a temperature above the freezing point with one or more concentrated tanks containing the concentrated juice located such as to effectively chill the concentrate along with the water and maintain desired temperature. A pumping unit is used to facilitate mixing of the concentrate with water in a mixing chamber for subsequent dispensing through the machine outlet.

U.S. Pat No. 6,240,829 discloses yet further beverage mixture forming apparatus involving a source of hot water, a source of cold water, a source of beverage concentrate, valve means to supply controlled hot/cold water in a batch vessel along with the beverage concentrate to obtain the beverage mixture.

U.S. Pat. No. 6,149,035 discloses yet another food and beverage dispensing system for holding and dispensing of beverage mixture comprising of water and dry concentrate. This prior art involves the use of a primary dispenser and the secondary dispenser wherein the secondary dispenser is operatively connected to said primary dispenser for supply of automatically prepared mix of water and dry concentrate to the primary dispenser in accordance with the amount of food or beverage mixture required to be dispensed from the primary dispenser. The primary dispenser can be a cooling equipment if the desired beverage is required to be cold such as iced fruit drinks.

It would be apparent from the above that various dispensing systems for dispensing beverages such as tea, coffee and the like have been available which are developed to serve specific end uses depending upon the selected beverage and its characteristics desired to be generated by such dispensers. Importantly, to serve such specific end uses/applications that there has been several variants of such systems which cater to specific needs and impart specific user-friendly character to the system.

However, the above prior art systems do involve complexities in manufacture and installation. In some cases the complexities are such that even servicing and maintenance of such units become a problem to the vendor or the ultimate user. While many of the conventional systems for dispensing beverages does include the possibility of dispensing a wide variety of instant beverages such as tea, coffee, chocolate, etc. considering the wide applications and uses and the present day requirements, it has always been a requirement to provide for such beverage dispensing systems which would be simple to obtain, be cost effective and most importantly be user-friendly both in terms of the requirement of the vendor and the consumer.

Additionally, in the case of known dispensers serving chilled/iced beverages it has been the usual practise in the art to provide refrigeration units to store chilled water wherefrom the chilled water is dispensed for preparation of the beverage along with the concentrate. This necessitated the need to provide gadgets to monitor the level of the stored water in the chiller unit at all time apart from adding to the load of the unit. Also, such systems occasionally experience problems of uneven chilling either too cold or not much cold resulting in problems of generating beverage of desired quality and taste.

It is thus the basic objective of the present invention to provide for a beverage dispenser which would meet the above requirements of the art and provide for a simple and cost effective dispensing system.

Another object is directed to provide a simple and cost-effective beverage dispenser especially to make cold beverages such as ice tea, coffee and the like from powders which would be simple to obtain, install and at the same time would be user-friendly to the vendor as well as the consumer.

Yet further object of the present invention is directed to provide a simple and cost effective beverage dispenser especially for cold beverages such as ice tea, coffee and the like which would provide for safe and controlled dispensing of beverages.

Yet further object is directed to provide a simple and cost effective beverage dispenser especially for cold tea, coffee and the like which would provide for effective control over the temperature of the water to facilitate uniform mixing with the premix powder of the beverage such as ice tea (lemon, peach or of desired flavour), coffee and the like to thereby enable serving of the instant beverage of desired taste and character to the consumer.

DESCRIPTION OF THE INVENTION

Thus, according to the present invention there is provided a beverage dispenser for cold tea, coffee and the like comprising:

a source of water distribution means which splits the flow of water from the source into a first stream and a second stream, a chiller unit where the temperature of the first stream is reduced water mixing means in which the first stream after it has passed through the chiller unit and second streams are mixed together the distributor means controlling the quantity of water in the first stream and the amount of time the water in the first stream spends in the chiller unit to ensure that when the first stream is mixed with the second stream in the water mixing means it provides a mixed water stream a desired temperature as it leaves the water mixing means, at least one valve means operatively connected to at least one beverage mixing unit, for supplying said mixed water stream to the beverage mixing unit, said beverage mixing unit further connected to at least one source of premix powder and adapted for mixing said premix powder and said mixed water stream to give the required beverage;

at least one outlet from said beverage mixing unit providing for selective dispensing the required beverage.

Importantly, in the above disclosed system of the invention, the supplied water used for the preparation of the beverage is effectively controlled to a desired temperature depending upon the beverage to be prepared. For the purpose, the system involves the use of the pump means and the distribution means to supply a first stream of water to the chiller unit such that during travel through the chiller unit the water is cooled to the desired temperature. This facilitates effective control of the temperature of the water used to prepare the beverage and avoids the use of chilled stored water in the known preparation of such beverages. Moreover, the distribution means also supplies a second stream of water at ambient temperature to mix with the first stream of water exiting from the chiller outlet to facilitate achieving the desired temperature of the water used for the preparation of the beverage. Accordingly, the system of the invention while on one hand provides for the desired cooling of water for preparation of such cold beverages such as ice tea, coffee and the like on the other hand also ensures that the water is not excessively cool and achieves the desired temperature for preparation of the beverage based on the desired temperature of beverage consumption. The above system while being effective in terms of controlling such temperature of the water is also simple and can thus be easily installed and maintained to provide user-friendliness both for the vendor and ultimately the consumer.

In a preferred embodiment of the present invention the beverage dispenser additionally comprises a source of hot water operatively connected to said beverage mixing unit through valve means to facilitate cleaning of the beverage mixing unit as and when required. This ensures the required hygienic and safety conditions for the dispenser for catering to supply of food products for human consumption such as instant beverages especially ice tea, coffee and the like. The cleaning system provides for automatic cleaning of the machine in particular the beverage mixing unit which are subject to contamination if not cleaned after repeated use/regular intervals. Preferably such cleaning can be attended at the start of the day by flushing hot water from the source through said beverage mixing units to effectively clean the later and possibly after pre-selected number of serving of the beverages through the beverage mixing unit. Additionally, the system can be automated such that after a regular interval whether or not any dispensing is effected through the beverage mixing unit the same is cleaned and flushed by the hot water to make it free of any contamination.

In a preferred embodiment the beverage dispenser of the present invention is provided with first temperature detecting means which measure the temperature of the water leaving the chiller unit. The first temperature detecting means is operatively connected to the distribution means to control the quantity of water in the first stream and the amount of time the water in the first stream spends in the chiller unit to ensure that the desired temperature of water in the first stream as it enters the water mixing unit is achieved.

In a further embodiment the beverage dispenser is provided with second temperature detecting means which measure the temperature of the water from the source or the water in the second stream and which are operatively connected to the distribution means so that the proportion of the water in the first and second streams is controlled to ensure that the mixed water stream leaving the water mixing unit is at the desired temperature.

It would also be apparent from the above disclosure that the system is such that it can be integrated to dispense beverages especially cold beverages of various varieties such as cold tea, coffee and the like. For such purpose depending upon the variety of beverages to be served, number of beverage mixing units may be provided each said beverage mixing unit operatively connected to one or more of the desired variety of pre-mix powder for the desired beverage/flavour to be prepared.

The beverage dispenser of the present invention may be fitted with means whereby the consumer can make payment for the beverage. Such payment means may accept payment in money (coins or notes), prepaid tokens or cards on which a prepaid amount can be recorded or debit and credit cards.

The details of the invention, its objects and advantages are explained hereunder in greater detail in the following non-limiting description of an embodiment thereof given by way of example only. The description has reference to the accompanying FIGURE which is a schematic illustration of the assembly of the various units constituting a dispenser of the invention intended to dispense ice tea.

Referring to the FIGURE, the ice tea dispenser of the invention comprises a chiller unit (1) having means to cool the water passing through said unit. For the purpose, a compressor (2) is shown operatively connected to the chiller unit (1). A water source (3) is operatively connected to said chiller unit (1) via pump means (4) and distributor means (5). The pump is adapted such that a first stream of water from the water source (3) is conveyed to the chiller unit (1) through the distribution means (5) in a controlled manner such that the water in the first stream traverses the chiller unit (1) for sufficient time and in pre-selected amounts such that first stream leaving the chiller unit is at a desired cool temperature.

The first stream is then mixed with the second stream in water mixing means (6). In accordance with a preferred aspect of the invention the temperature of the first stream of water exiting from the chiller unit (1) is monitored by first temperature detecting means (not shown). The first temperature detecting means is operatively connected to the distribution means to ensure that the requisite amount of the first stream is mixed with required amount of the second stream of water in the water mixing means (6) prior to being fed to beverage mixing unit(s) (7,8). As further illustrated in the FIGURE, the mixed water stream leaving the water mixing means (6) is fed to the beverage mixing unit (7,8) via valve means (9,10). Importantly, depending upon the capacity of the dispenser and the variety of the beverages to be dispensed, the number of mixing units can be varied. In the embodiment illustrated in the FIGURE, two beverage mixing units (7,8) are illustrated. The respective mixing units (7,8) are operatively connected to containers (11, 12) holding different varieties of ice tea pre-mix powder. For example container (11) may contain a lemon pre-mix powder and container (12) may contain a peach pre-mix powder.

Thus, for obtaining the ice tea using the system the first stream of water is fed at desired amounts and duration to the chilling unit (1). The first stream of water thus cooled and exiting from the chiller unit (1) is monitored and is admixed with required quantity of the second stream of water supplied from the distribution means (5) to achieve a mixed water stream of the desired temperature for preparation of the ice tea as it leaves the water mixing means. Thereafter, depending upon the flavour of the ice tea beverage desired, the mixed water stream is fed through valve (9) to beverage mixing unit (7) for obtaining lemon ice tea or through valve (10) to beverage mixing unit (8) for obtaining peach ice tea. Accordingly, if lemon tea is desired the premix powder is fed from container (11) into the beverage mixing unit (7) and if peach tea is desired the premix powder is fed from container (12) into the beverage mixing unit (8). Thereafter, after adequate mixing of the mixed water stream and the premixed powder in the respective beverage mixing unit the beverage is ready for dispensing for consumption.

Importantly, in accordance with a further aspect of the invention to provide for hygienic and safe beverage dispensing, the system additionally provides for automatic cleansing of the beverage mixing unit. For the purpose, a hot water source (14) is provided which supplies water to the beverage mixing units through valve means (13). As and when required, the beverage mixing units are flushed with the hot water from the hot water source (14) to cleanse them thoroughly for subsequent preparation and dispensing of ice tea.

In the chiller unit (1), the first water stream is chilled preferably in the temperature range of 1–3° C. which is subsequently controlled to the desired temperature by mixing it with the second water stream supplied directly from the distribution means (5). The mixing of the ambient and chilled water thus provides for achieving the right temperature for the mixed water stream for the preparation of an ice tea drink without affecting the effectiveness of the chilling unit (1).

It is thus possible by way of the above invention to provide for a simple and cost effective dispenser for instant beverages such as ice tea, coffee and the like which would provide for generation of such beverages at controlled temperatures thereby catering to the needs and tastes of the ultimate consumers. Importantly, the system while providing for the desired chilling of the water for preparation of ice tea, coffee and the like takes care of problems associated with chillers with stored chilled water mostly used in beverage dispensers. For the purpose the system of the invention effectively integrates and controls the passage of the water from the source through the chilling unit (1) to provide for a regulated online supply of chilled water avoiding the problems and disadvantages of the stored chilled water used in conventional dispensers. Moreover, in a preferred embodiment, the use of the distribution means (5) apart from providing for the regulated and controlled flow of water through the chiller unit (1) serve the further purpose of monitoring the chilled water temperature exiting from the chiller unit (1) and mix the same with the desired quantity of ambient water to achieve the right temperature of the water for such beverage preparation such as ice tea, coffee and the like. Such effective control of the water temperature used in the beverage preparation in the dispenser of the invention provides for effective dispensing of beverages with uniform and acceptable taste and character for the ultimate consumers. Moreover, the dispenser involves simple and cost effective components which is easy to install and maintain by the vendors which provides for additional advantage for the dispenser of this invention. Moreover, as would be apparent from the above, the dispenser can provide for a composite unit serving variety of beverages depending upon the requirements and the choice of vendors/consumers. Additionally, the dispenser ensures the safety and hygiene required in beverage preparation and dispensing units and provides for safe and quality dispensing of cold beverages.

What is claimed is:

1. A beverage dispenser for beverages such as cold tea, coffee and the like comprising:

a source of water distribution means which splits the flow of water from the source into a first stream and a second stream, a chiller unit where the temperature of the first stream is reduced water mixing means in which the first stream after it has passed through the chiller unit and second streams are mixed together the distribution means controlling the quantity of water in the first stream and the amount of time the water in the first stream spends in the chiller unit to ensure that when the first stream is mixed with the second stream in the water mixing means it provides mixed water stream for beverage preparation of a desired temperature as it leaves the water mixing means, at least one valve means operatively connected to at least one beverage mixing unit, for supplying said mixed water stream to the beverage mixing unit, said beverage mixing unit further connected to at least one source of premix powder and adapted for mixing said premix powder and said mixed water stream to give the required beverage;

at least one outlet from said beverage mixing unit providing for selective dispensing the required beverage.

2. A beverage dispenser as claimed in claim 1 which additionally comprises a source of hot water operatively connected to said beverage mixing unit through valve means to facilitate cleaning of the beverage mixing unit as and when required.

3. A beverage dispenser as claimed in claim 1 which additionally comprises first temperature detecting means to measure the temperature of the water leaving the chiller unit, said first temperature detecting means being operatively connected to the distribution means to control the quantity of water in the first stream and the amount of time the water in the first stream spends in the chiller unit to ensure that the desired temperature of water in the first stream as it enters the water mixing unit is achieved.

4. A beverage dispenser as claimed in claim 1 which additionally comprises second temperature detecting means to measure the temperature of the water from the source or the water in the second stream, said second temperature detecting means being operatively connected to the distribution means so that the proportion of the water in the first and second streams is controlled to ensure that the mixed water stream leaving the water mixing unit is at the desired temperature.

* * * * *